US006537111B2

(12) United States Patent
Brammer et al.

(10) Patent No.: US 6,537,111 B2
(45) Date of Patent: Mar. 25, 2003

(54) ELECTRIC CONTACT PLUG WITH DEFORMABLE ATTRIBUTES

(75) Inventors: Christian Brammer, Winsen (DE); Peter Homann, Neustadt (DE); Werner Dreyer, Garbsen (DE); Bernd Kiel, Wunstorf (DE); Jens Gröger, Hannover (DE); Stefan Klik, Hannover (DE); Oliver Gründker, Wedemark (DE); Stefan Knoke, Hannover (DE)

(73) Assignee: Wabco GmbH and Co. OHG, Hannover (DE)

( * ) Notice: Subject to any disclaimer, the term of this patent is extended or adjusted under 35 U.S.C. 154(b) by 0 days.

(21) Appl. No.: 09/862,633

(22) Filed: May 22, 2001

(65) Prior Publication Data

US 2001/0049238 A1 Dec. 6, 2001

(30) Foreign Application Priority Data

May 31, 2000 (DE) ..... 100 27 125

(51) Int. Cl.[7] ..... H01R 11/22; H01R 13/11

(52) U.S. Cl. ..... 439/857; 439/862

(58) Field of Search ..... 439/857, 862, 439/856, 858, 608

(56) References Cited

U.S. PATENT DOCUMENTS

| | | | | |
|---|---|---|---|---|
| 4,303,294 A | | 12/1981 | Hamsher, Jr. et al. | 439/267 |
| 5,004,426 A | * | 4/1991 | Barnett | 439/82 |
| 5,286,208 A | | 2/1994 | Matsuoka | 439/72 |
| 5,564,952 A | * | 10/1996 | Davis | 439/682 |
| 5,634,830 A | * | 6/1997 | Weingartner | 439/857 |
| 6,050,863 A | * | 4/2000 | Noda | 439/856 |
| 6,116,926 A | * | 9/2000 | Ortega et al. | 439/108 |
| 6,224,432 B1 | * | 5/2001 | Billman | 439/856 |

FOREIGN PATENT DOCUMENTS

| | | | |
|---|---|---|---|
| DE | 1080650 | 4/1960 | |
| DE | 8711110 | 12/1987 | |
| DE | 3709903 | 9/1993 | |
| EP | 0144128 | 6/1985 | H01R/13/115 |
| EP | 0411888 | 2/1991 | H01R/13/11 |
| EP | 0649701 | 10/1994 | |
| EP | 0678936 | 4/1995 | |
| EP | 0794847 | 11/1995 | |

* cited by examiner

*Primary Examiner*—Lynn Field
*Assistant Examiner*—Hae Moon Hyeon
(74) *Attorney, Agent, or Firm*—Proskauer Rose LLP

(57) ABSTRACT

An electric contact plug receives a tip jack input at a plug-in zone, and completes the electrical connection via a connection zone to an electronic component, such as a printed circuit board. The electric contact plug also includes an intermediate zone, connected between the plug-in zone and the connection zone. The intermediate zone is designed to deform mechanically when the plug-in zone is subjected to vibrational stresses, as typically occur in a motor vehicle. As a result, the tip jack is held securely within the plug-in zone, while the intermediate zone absorbs the effects of the vibrational stresses. Thus, the inventive electric contact plug avoids the problems of friction and corrosion within the plug-in zone. Moreover, this electric contact plug is compatible with thick-wire bonding, and can be manufactured economically.

20 Claims, 8 Drawing Sheets

ELECTRIC CONTACT PLUG WITH DEFORMABLE ATTRIBUTES

BACKGROUND OF THE INVENTION

The present invention relates to a contact plug that enables the electrical connection of a plug-in terminal and an electronic component. More particularly, the present invention relates to an electric contact plug for connecting a type of tip jack input device to an external electronic circuit.

This type of electric contact plug is frequently used in application environments that are exposed to relatively high vibration levels, as, for example, in a motor vehicle. Since the connection principle for this type of electric contact plug is based on a clamping effect between the electric contact plug and the input device, relative movement may occur between the electric contact plug and the input device, depending on the force of the vibrations. As a result, this relative movement can cause undesirable wear and/or corrosion of both the contact plug and the input device.

Therefore, it is desirable for an electric contact plug used in a motor vehicle to avoid the problems of friction wear and corrosion, and yet be simple and economical to manufacture. Furthermore, it is desirable to configure such an electric contact plug in a single unit, and it should also be compatible with thick-wire bonding techniques, which are becoming ever more popular in automotive technology.

A process and apparatus for a prior art type of connection device is disclosed in European patent documents EP 0 794 847 B1 and EP 0 649 701 A1, which are incorporated herein by reference. A miniature tip jack that is free of frictional corrosion is disclosed in EP 0 794 847 B1. This tip jack, however, is expensive to produce, because of its relatively complicated configuration, and its high cost. Moreover, this prior art tip jack cannot be used for thick-wire bonding.

Therefore, it is an object of the present invention to configure an electric contact plug that avoids the aforementioned friction and corrosion problems, that is compatible with thick-wire bonding applications, and that can be produced easily and economically.

SUMMARY OF THE INVENTION

This object is attained through an inventive embodiment of an electric contact plug, which receives a tip jack input at a first end, and routes this electrical connection to an electronic component, such as a printed circuit board, at a second end. The inventive electric contact plug comprises:

a) a plug-in zone at the first end, located within an L-shaped area of the electric contact plug, and having receiving tongues for receiving the tip jack, b) a connection zone at the second end, having a bonding pad for connecting to the electronic component, c) an intermediate zone, connected between the plug-in zone and the connection zone, wherein the intermediate zone comprises at least one form-changing area, having less resistance to form change than other areas of the intermediate zone, which enables the plug-in zone to move in a plug-in direction, as the intermediate zone is deformed.

Thus, when vibrations occur, as in a motor vehicle, the tip jack is held securely within the tongues of the plug-in zone, while the intermediate zone form-changing area(s) allow for movement to compensate for any vibrational stresses. As a result, deterioration of the plug-in zone is avoided by eliminating friction between the tip jack and the receiving tongues of the plug-in zone.

The expression "resistance to form changes" shall hereinafter designate a material characteristic that is essentially inversely proportional to the elasticity of the material.

The purpose of the essentially L-shaped form of the electric contact plug, as well as the location of the plug-in zone in this L-shaped area, is to achieve an especially compact structure. The expression "L-shaped" shall include in this context, not only an exact right angle between the legs of the L-shaped area, but also minor deviations from a right angle.

The inventive electric contact plug can be used to special advantage for the connection of electrical/mechanical components, such as pressure sensors and solenoid valves, to an electronic control system. In a preferred application of the invention, such electrical/mechanical components are installed in an electronic control apparatus, together with the electronic control system. Due to the deformability of the inventive electric contact plug, tolerances can be compensated for during the manufacture and assembly of the electronic control apparatus.

In an advantageous embodiment of the invention, the entire plug-in zone is located in one leg of an L-shaped area, while the other leg functions as a bending beam, as is known in the mechanical technology art.

The problems of frictional wear and frictional corrosion are avoided in the inventive electric contact plug, as a result of the deformability of the intermediate zone. This deformability allows a limited movement of the plug-in zone, relative to the connection zone, so that smaller movements of the PLUG IN connection, as might be caused by vibrations, are eliminated through the compensating action of the intermediate zone. To this end, at least one form-changing area, with a lower resistance to form change than other areas of the intermediate zone, is included within the intermediate zone. As a result, the deformation of the intermediate zone takes place at a defined location, in the manner of an articulation.

In an advantageous further development of the invention, a second form-changing area, with reduced resistance to form change, is also included within the intermediate zone. This is done so that the preferred form changes of both the first and second form-changing areas take place along parallel axes. The advantage over a single form-changing area is that pivoting of the plug-in zone, when subject to vibrations, can be more easily avoided. In addition, relative movement between the plug-in zone and the electric contact plug, at a right angle to the plug-in direction, can also be more easily avoided. Furthermore, frictional forces between the plug-in zone and the sides of a receiving device holding the electric contact plug can be avoided, or at least reduced.

In another advantageous development, the inventive electric contact plug may include multiple angles in the area of the connection zone, and/or the intermediate zone, preferably in the form of an S, or a meandering form. This type of configuration can result in an especially small and compact electric contact plug, which enables it to be used in electronic devices where space is at a premium.

In another advantageous development of the invention, the connection zone also serves as a mechanical attachment point for the electric contact plug, obviating the need for another special area of the electric contact plug to be used for this purpose. This feature enhances both the economic production and the compact configuration of the electric contact plug.

The first and/or second form-changing areas have, as previously described, a lower resistance to form change than the other areas of the intermediate zone. This increased elasticity can be achieved, e.g., by subjecting the form-changing areas to heating, while the cross-section of the material remains essentially unchanged. In accordance with another advantageous embodiment of the invention, a lower resistance to form change can also be achieved by reducing the cross-section of the material in the intermediate zone.

For this embodiment, it is especially advantageous to reduce the thickness of the material, because this results in a significant reduction of the geometrical moment of inertia for a comparatively minor reduction of the cross-section of the material. As such, the electrical resistance of the intermediate zone is increased minimally in the form-changing areas.

In another advantageous development of the invention, the plug-in zone has at least two receiving tongues to receive a tip jack, or similar input device. The exterior contour of the receiving tongues tapers in the direction away from the intermediate zone, when the input device is not plugged in. In comparison with prior art contact plugs, whose exterior contours of the plug-in zone are essentially parallel, this tapering feature of the inventive plug-in zone provides an increased clamping force between the receiving tongues and the input device, while the space requirement remains the same. As a result, subsequent frictional wear and corrosion in the plug-in zone can be avoided even more efficiently.

Another feature of the invention is that the cross-sectional surface in at least part of each receiving tongue changes in a linear fashion, preferably in the central area of the receiving tongue. Therefore, when the input device is plugged in, thus expanding the plug-in zone of the electric contact plug, the resulting mechanical stresses are distributed evenly, minimizing the possibility of excessive localized stress. As such, the material requirements, and corresponding weight of the contact plug, are reduced. This enhances the durability and reliability of the inventive electric contact plug.

It is advantageous to design the spring action of the receiving tongues so that the holding force against the input device is greater than, and preferably twice that, of the force required to overcome the resistance to form change of the form-changing areas, which enable deformation in the intermediate zone.

In accordance with another advantageous development, the connection zone of the electric contact plug has a bonding area, for making a connection to an electronic component. Thus, the inventive electric contact plug is fully compatible with applications requiring thick-wire bonding technology. Typically, electric contact plugs are made of copper-beryllium, or copper-tin material. These materials, however, are subject to oxidation, which is detrimental to the application of thick-wire bonding technology. In another advantageous development of the invention, therefore, the bonding area is provided, at least in part, with an aluminum coating. As such, the inventive electric contact plug can be used advantageously in thick-wire bonding applications, since an aluminum-oxide layer is not detrimental to bonding. It is also advantageous to employ laser cleaning of the bonding area immediately before bonding. Where this type of cleaning is used, it is possible to dispense with the aluminum coating.

In another advantageous development, the connection zone is coated galvanically in the bonding area. The preferred coating material for this application is nickel-phosphorus.

Another feature of the invention is that a receiving device is used to house the electric contact plug, with the connection zone held securely in place, relative to the receiving device. The electric contact plug can be assembled quite easily, and can be attached to an external electrical device by means of extrusion-coating the receiving device. In this configuration, the plug-in zone retains its mobility relative to the connection zone, since the connection zone is fixed relative to the electrical device, due to its immobile position in the receiving device.

It should be noted that an extrusion-coating finishing step is different from a casting finishing step, because the extrusion coating always results in a rigid attachment. In a casting finishing step, an elastic attachment is also possible, as for example, when using a permanently elastic casting mass.

In the assembly of a receiving device by the extrusion-coating method, it is desirable to use a relatively hard, or inflexible material, preferably hard plastic. It is also desirable to use a labyrinth seal to protect the interior of the receiving device from the extrusion-coating mass.

In a preferred embodiment of the receiving device, a mobility-limiting means is incorporated internally, which limits the mobility of the plug-in zone and/or the intermediate zone, relative to the receiving device. Through suitable sizing of this mobility-limiting means, the anticipated vibration stresses are absorbed adequately, which prevents the occurrence of large movements, or plastic deformation, of the electric contact plug.

Finally, another advantageous embodiment of the invention comprises a receiving device configured in two parts. This embodiment can take either of two forms:

a) where the separation plane 34 of the two parts is essentially perpendicular to the axis 19 of the preferred deformation direction of the first form-changing area, as shown in FIG. 7, and b) where the separation plane 35 is essentially parallel to the axis 19 of the preferred deformation direction of the first form-changing area, as shown in FIG. 16.

Either configuration allows for the simple assembly of the electric contact plug within one part of the receiving device, with the other part enclosing the open side of the electric contact plug, and attaching to the first part in an interlocking fashion, thus completing the assembly of the electric contact plug within the receiving device. Due to the simplicity and ease of this type of assembly configuration, the manufacture of the inventive electric contact plug and receiving device can be fully automated, and implemented by machine.

BRIEF DESCRIPTION OF THE DRAWINGS

The invention is described in greater detail below through the example of embodiments shown in the drawings, wherein.

The same reference designations are used throughout the drawings for equivalent parts.

DETAILED DESCRIPTION OF PREFERRED EMBODIMENTS OF THE INVENTION

Figure 1:
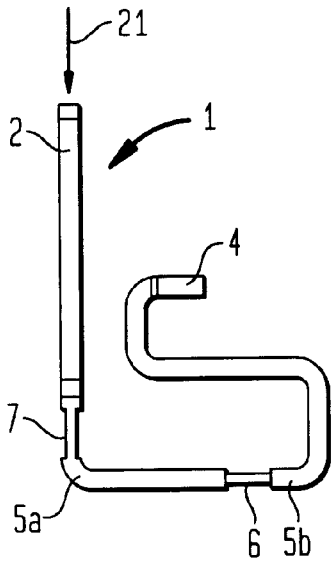
FIGS. 1 to 3 show three views of a preferred embodiment of an electric contact plug, in accordance with the invention.
Figure 2:
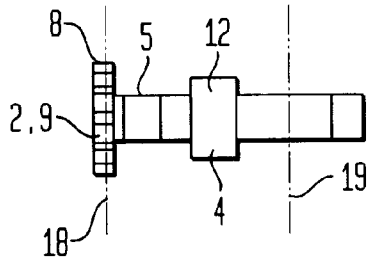

One embodiment of the inventive electric contact plug 1 is shown in FIG. 1. This embodiment is comprised of an L-shaped structure 2, 7, 5*a*, connected to an S-shaped (or meander-shaped) structure 4, 5*b*, 6. The inventive electric contact plug has a plug-in zone 2, contained within one leg of the L-shaped structure, for receiving an external tip jack 3. At its other end, the electric contact plug 1 has a connection zone 4, contained within the S-shaped area, which serves to connect the electric contact plug 1 to an electronic component, such as a printed circuit board. In a preferred embodiment of the present invention, the connection zone 4 includes a bond pad 12, as shown in FIG. 2, which is used for connecting to an electronic component, by means of thick-wire bonding. The bond pad 12 is preferably configured as an integral part of the electric contact plug 1.

Copper beryllium and copper tin are the preferred materials to be used for the electric contact plug 1. The bond pad 12 is preferably coated with aluminum. The bond pad 12 can also undergo laser cleaning, either as an alternative to, or in addition to, an aluminum coating.

Referring again to FIG. 1, the electric contact plug 1 has an intermediate zone 5*a*, 5*b* between the plug-in zone 2 and the connection zone 4. The intermediate zone 5*a*, 5*b* overlaps the L-shaped and the S-shaped structures of the electric contact plug 1, and can be deformed, in order to give the plug-in zone 2 sufficient flexibility in the plug-in direction 21, to compensate for vibrations. The intermediate zone 5*a*, 5*b* is configured as a longitudinal element, and serves as a bending beam. In order to control the amount of deformation, a first form-changing area 6 and a second form-changing area 7 are connected to the intermediate zone elements 5*a*, 5*b*. As shown in FIG. 1, the first form-changing area 6 is located in the horizontal leg of the L-shaped structure, and the second form-changing area 7 is located in the vertical leg of the L-shaped structure. That is, the intermediate zone 5*a* is bent essentially at a right angle between the form-changing areas 7 and 6. As such, the preferred deformation directions of the first and second form-changing areas 6 and 7 are along parallel axes, as indicated in FIG. 2 by broken lines 18, 19. In FIG. 1, these axes 18, 19 are therefore perpendicular to the plane of the paper. As a result of using the two form-changing areas 6 and 7, as described above, plug-in zone 2 becomes highly resistant to pivoting motions due to vibrations, and friction wear in the plug-in zone is therefore effectively suppressed.

The form-changing areas 6, 7 are designed to have a lower resistance to deformation than the intermediate zone elements 5*a*, 5*b*. This can be implemented in one preferred embodiment of the invention by reducing the cross section of the form-changing areas 6, 7, relative to the intermediate zone elements 5*a*, 5*b*. In another embodiment of the invention, the form-changing areas 6, 7 are made with a thinner material thickness than the intermediate zone elements 5*a*, 5*b*, but without reducing the cross-section of the form-changing areas 6, 7. This makes it possible to achieve a geometric moment of inertia that is relatively low in relation to that cross-section, whereby a good compromise is achieved between easy deformability of the form-changing areas 6, 7 and their electrical resistance characteristics, which should be kept as low as possible to avoid unnecessary losses.

One illustrative method of making the form-changing areas 6, 7 is to taper the material of the intermediate zone elements 5*a*, 5*b* by means of stamping. In this type of process, the thickness and width of the intermediate zone 5*a*, 5*b* material is approximately halved.

Another illustrative method of implementing the form-changing areas 6, 7 achieves local weakening of these areas by heating, while maintaining the cross-section of the material unchanged. A combination of the methods described above can also be advantageous.

Figure 3:
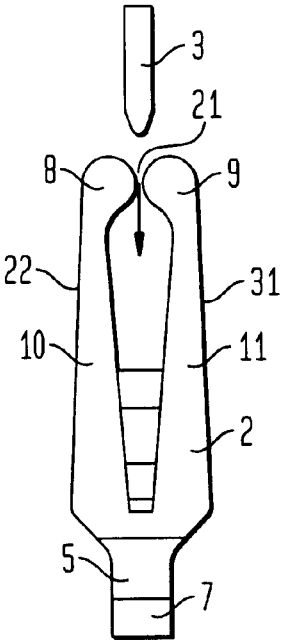
Figure 4:
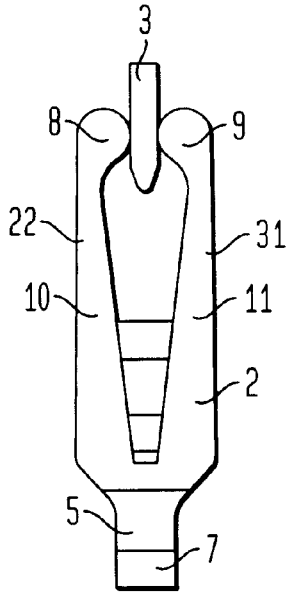
FIG. 4 shows the electric contact plug of FIG. 3 with a tip jack inserted.

As shown in FIG. 3, the plug-in zone 2 has two receiving tongues 8, 9, which are used to receive the tip jack 3. When the tip jack 3 is plugged in, as shown in FIG. 4, the plug-in zone 2 receiving tongues 8, 9 are expanded, and the tip jack 3 is held in place by the spring action of the material of the receiving tongues 8, 9. As a result of this spring action, the plug-in zone 2 is immobilized relative to the tip jack 3, even when forces are present in the plug-in direction 21, as long as these forces do not exceed the frictional holding force of the receiving tongues 8, 9.

In an advantageous embodiment of the present invention, the first form-changing area 6, and/or the second form-changing area 7, are designed to deform as a result of a force acting in the plug-in direction 21, such that the plug-in zone 2 does not move relative to the tip jack 3. For this reason, the frictional spring force between the tip jack 3 and the plug-in zone 2 must be greater than the deformation force of the form-changing areas 6, 7. This frictional spring force is preferably selected to be significantly greater, or about twice as great as the deformation force of the form-changing areas 6, 7. As a result, undesirable frictional movement between the tip jack 3 and the plug-in zone 2 is avoided when vibration type of stresses occur. By avoiding such frictional movements, the life of the plug-in connection is extended, since there is no frictional wear or frictional corrosion.

As can be seen in FIG. 3, the external contours 22, 31 of the receiving tongues 8, 9, respectively, taper in a direction away from the intermediate zone 5 when the tip jack 3 is not plugged in, i.e., in the direction opposite to the plug-in direction 21. With the tip jack 3 plugged in, as shown in FIG. 4, the external contours 22, 31 are essentially parallel with each other, resulting in a compact construction, coupled with a strong holding force for the retention of the tip jack 3. The cross-sectional surfaces of each receiving tongue 8, 9 change in an essentially linear manner, at least in the limited zones 10, 11 of the respective receiving tongues 8, 9. As such, the mechanical stresses are evenly distributed when the tip jack 3 is plugged in.

Figure 5:
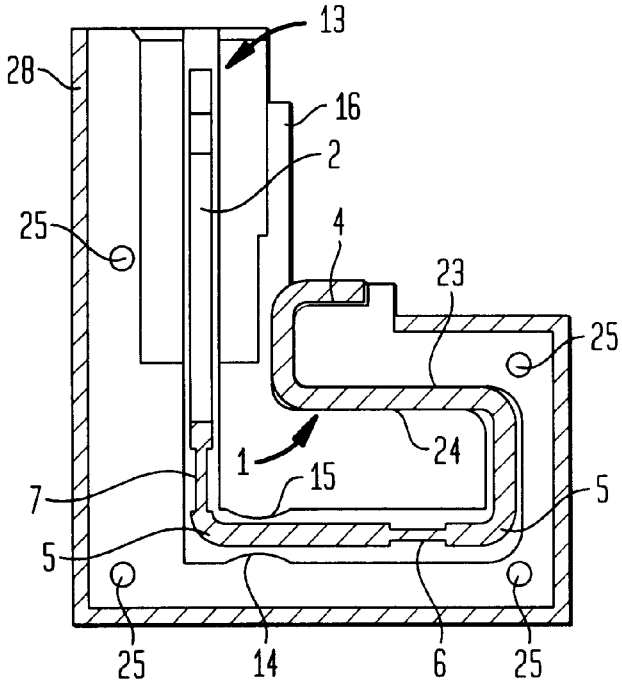
FIG. 5 is a side view of an electric contact plug and receiving device, in accordance with the invention.

FIGS. 5 to 8 show different aspects of a receiving device 13. FIG. 5 shows the installation of the electric contact plug 1 in a half-cup 16 of the receiving device 13. The connection zone 4 of the electric contact plug 1 is locked in place by the holding means 23, 24, such that connection zone 4 is held immobile in the receiving device 13. The plug-in zone 2, as well as most, or all, of the intermediate zone 5, can move to a limited extent, relative to the receiving device 13. The mobility of the intermediate zone 5 is limited to a desired extent by the motion limiting means 14, 15. This limitation of mobility should, e.g., avoid a plastic deformation of the intermediate zone 5.

Figure 6:
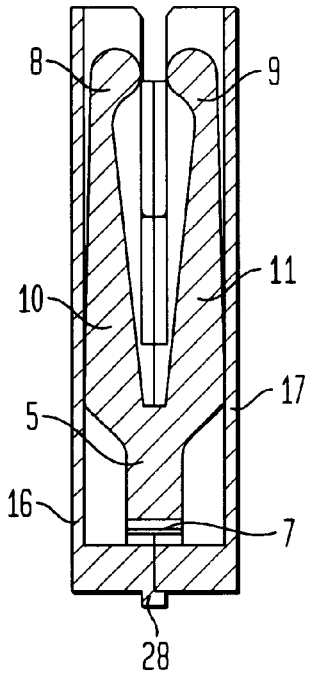
FIG. 6 is a front sectional view of an electric contact plug and receiving device, in accordance with the invention.

After installing the electric contact plug 1 into a first half cup 16, as shown in FIG. 5, a second half-cup 17 is then placed over the contact plug 1, as shown in FIG. 6. The completed assembly can then be installed in an electronic device, e.g., by extrusion-coating the receiving device 13 into the electronic device. The half-cups 16, 17, which are preferably made of plastic, serve as a protective support surrounding the electric contact plug 1. This installation process is preferably automated, by using an insertion machine designed for that purpose.

Figure 7:
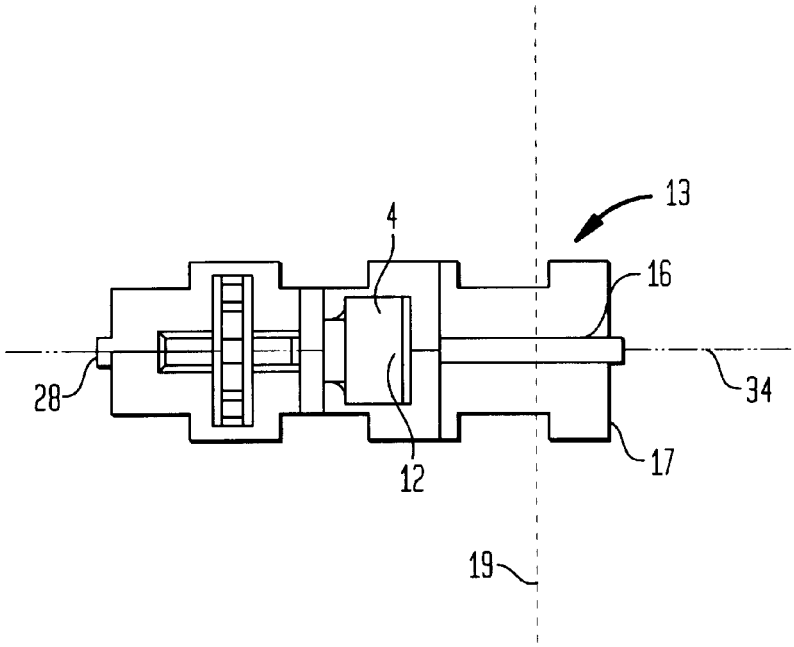
FIG. 7 is a top view of an electric contact plug and receiving device, in accordance with the invention.
Figure 8:
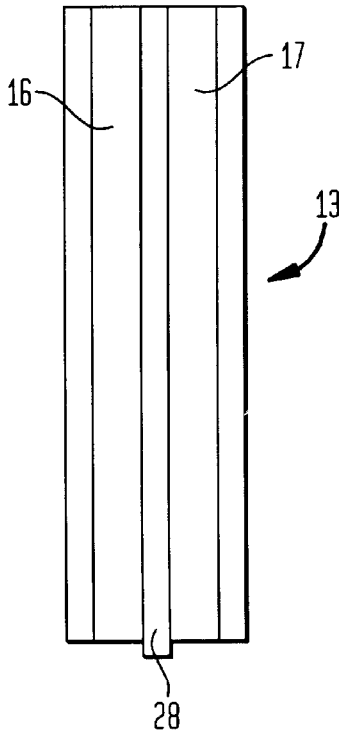
FIG. 8 shows the receiving device of FIG. 6.

In order to avoid the penetration of any extrusion-coating mass into the receiving device 13, a labyrinth seal 28 is provided (FIGS. 6–8). The labyrinth seal 28 is preferably configured as a protrusion, extending all around the half-cup 16, and overlapping the edge of the half-cup 17, when assembled.

Figure 9:
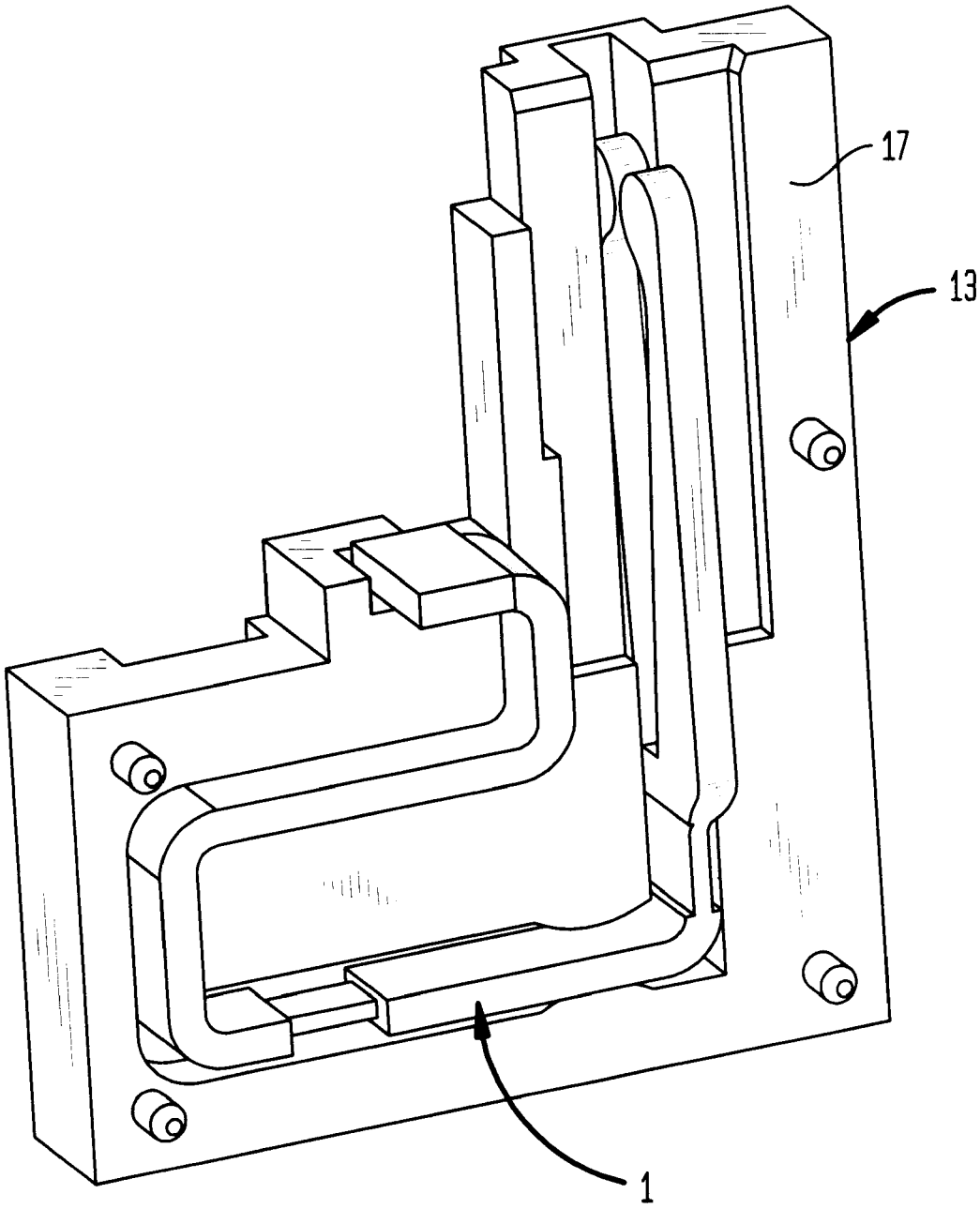
FIG. 9 is a perspective view of an electric contact plug and one side of a receiving device, in accordance with the invention.

FIG. 9 shows a perspective view of the electric contact plug 1 inserted into the half-cup 17, for clarity.

Figure 10A:
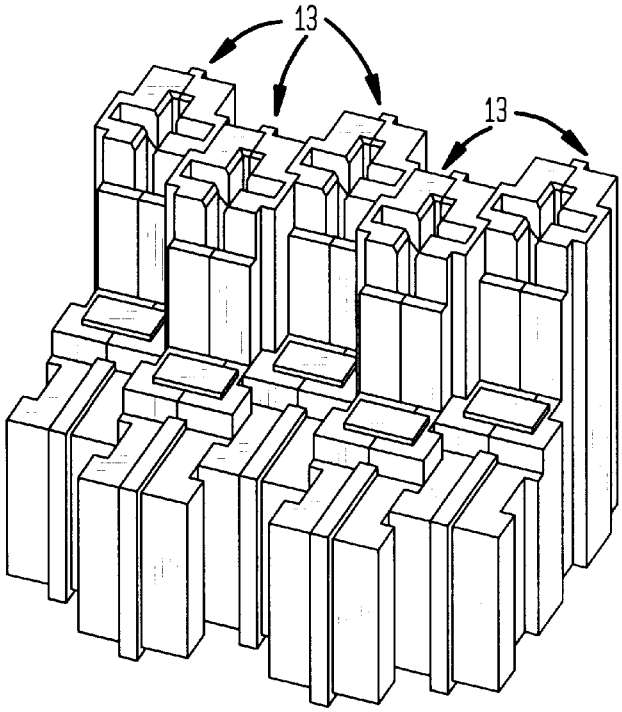
FIGS. 10*a* and 10*b* show two examples of alignment configurations for the receiving devices.
Figure 10B:
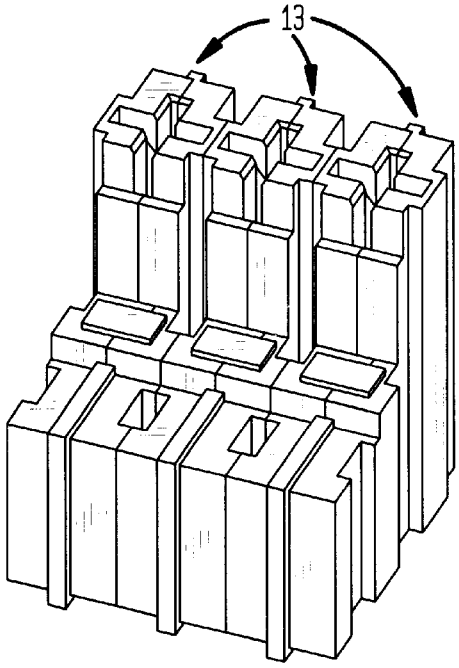

To illustrate additional embodiments of the present invention, FIGS. 10*a* and 10*b* show how multiple receiving devices 13 can be configured as multiple plug-in connectors. FIG. 10*a* shows an example of offset receiving devices 13, and FIG. 10*b* shows an example of an aligned arrangement. In an alternative embodiment, the receiving devices 13 can be aligned in a row, in a unified modular configuration.

FIGS. 11 to 14 show various embodiments of the electric contact plug 1, in accordance with the invention, and corresponding connection configurations to a printed circuit board 20, by means of a bonding wire 26. For clarity, FIGS. 11 to 14 are not drawn to exact scale. Crosses are used to indicate the form-changing areas 6, 7.

Figure 11:
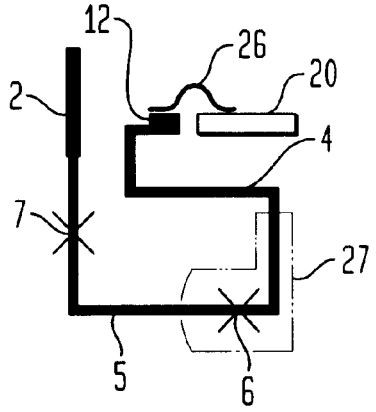
FIGS. 11 to 14 depict various embodiments of an electric contact plug, in accordance with the invention.

The embodiment shown in FIG. 11 corresponds to that of FIG. 1. In addition, an area 27 is indicated in FIGS. 11 to 14 for each configuration shown, in which the first form-changing area 6 can be advantageously installed.

Figure 12:
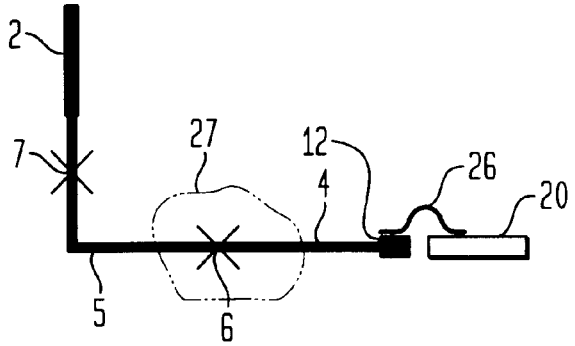
Figure 13:
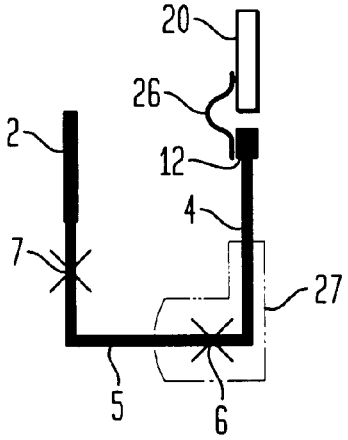
Figure 14:
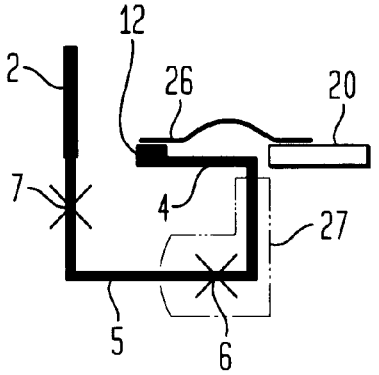
Figure 15:
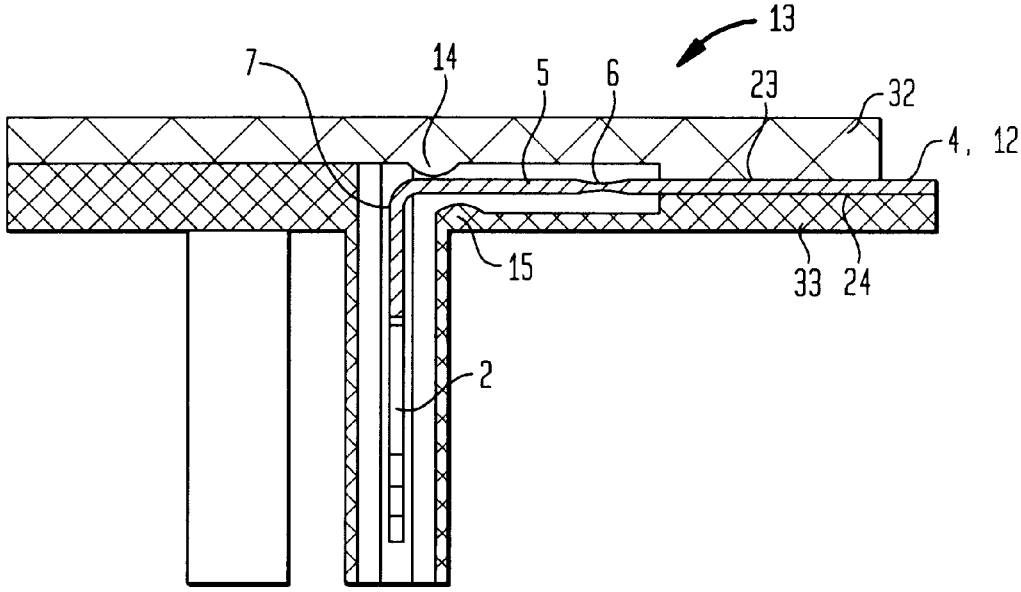
FIGS. 15 to 17 show another preferred embodiment of an electric contact plug and receiving device, in accordance with the invention.
Figure 16:
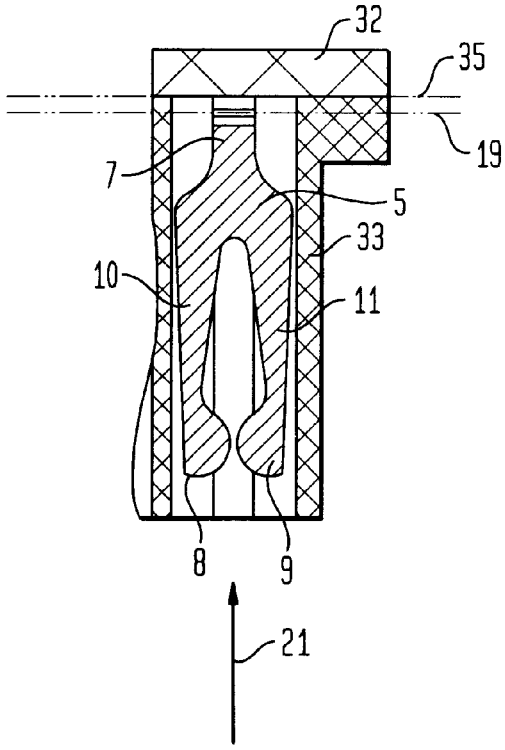
Figure 17:
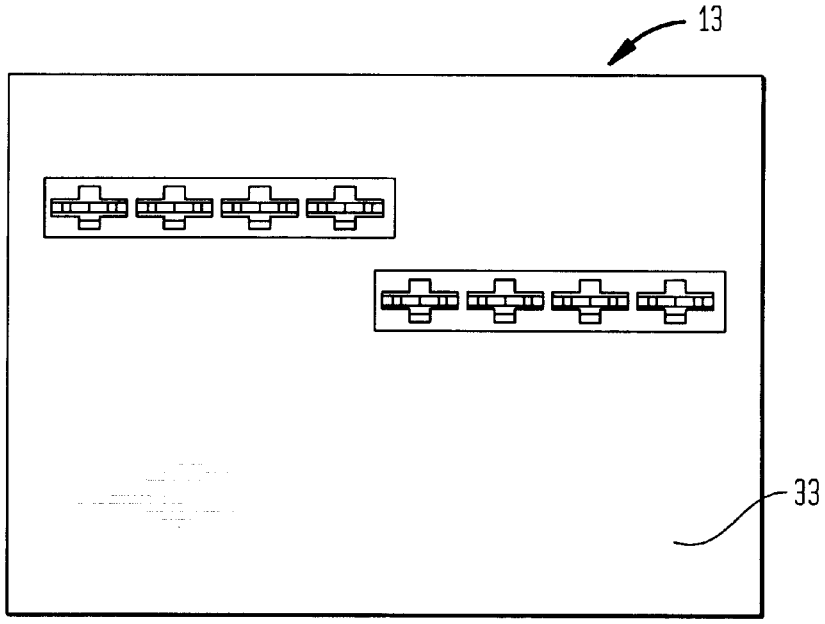

The configuration of the electric contact plug 1 of FIG. 12 is shown in combination with an additional embodiment of the receiving device 13, in FIGS. 15 to 17. The receiving device 13 has a separation plane 35 parallel to the axis 19 of the preferred deformation direction of the first form-changing area 6. As shown in FIG. 16, the receiving device 13 has two enclosure parts 32, 33, which can be assembled easily and precisely, by means of interlocking devices 25 (FIG. 5).

Figure 18:
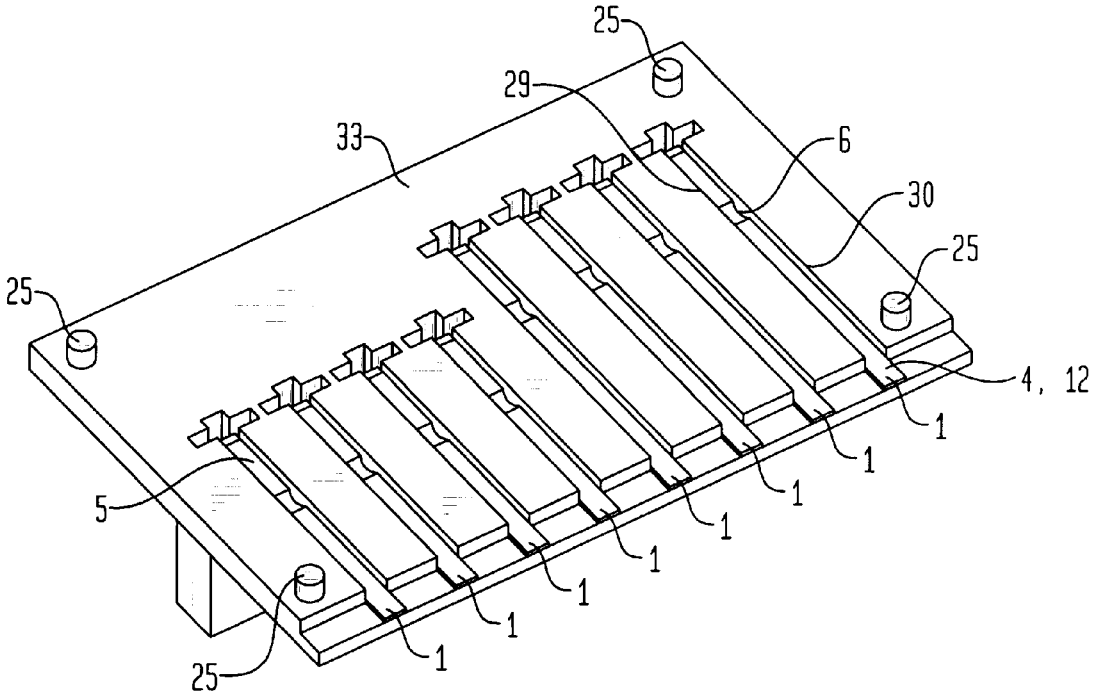
FIG. 18 shows a perspective view of the electric contact plug and receiving device of FIGS. 15 to 17.

FIGS. 17 and 18 show an embodiment of the receiving device 13 especially designed to receive several electric contact plugs 1. The electric contact plugs 1 are initially punched out and bent as a single part. The resultant punched-out grid is then placed into the lower part 33 of the receiving device 13, which contains channel-like grooves to serve as holding means (29, 30 in FIG. 18, and 24 in FIG. 15). Although not shown here, the upper part 32 is preferably provided with ridges in the areas facing the channel-like grooves, when assembled.

The upper part 32 is then mounted to the lower part 33 of the receiving device 13, so that the electric contact plugs 1 are mechanically fixed on all sides in the area of the connection zone 4 (FIGS. 15 and 18), by means of holding devices 23, 24 (FIG. 15), and 29, 30 (FIG. 18). Raised ridges (not shown) of the upper part 32 fit securely into the channel-like grooves (29, 30 in FIG. 18, and 24 in FIG. 15) of the lower part 33. As such, the deformability of the intermediate zone 5 is maintained. The receiving device 13 can then be extrusion-coated. The contacts can be separated as desired, either before or after the extrusion-coating process.

For clarity, only one of the electric contact plugs 1 shown in FIG. 18 is given the above described reference designations.

The previously described arrangements of electric contact plugs and receiving devices are applicable to the connection of an electrical/mechanical component, such as a pressure sensor or solenoid valve installed within an electronic control device, to an electronic control system.

In short, a small, compact connector configuration is disclosed herein, comprising easily assembled and disassembled connections between electrical/mechanical components and an electronic control system. Moreover, a plurality of components can be connected simultaneously by means of a single plug-in process. In contrast to prior art connecting processes, e.g., plug-in connections tied to cables, or flexible printed-circuit films, the inventive plug-in connection is mechanically robust, and can endure thermal stress.

While the invention has been described by reference to specific embodiments, this was for purposes of illustration only and should not be construed to limit the scope of the invention. Numerous alternative embodiments will be apparent to those skilled in the art.

What is claimed is:

1. An electric contact plug, for receiving a tip jack input device at a first end, and for connecting to an electronic component at a second end, comprising:

a) a plug-in zone at said first end, located within an L-shaped area of said electric contact plug, for receiving said tip jack input device, b) a connection zone at said second end, for connecting to said electronic component, c) an intermediate zone, located between said plug-in zone and said connection zone, wherein said intermediate zone comprises at least a first form-changing area, having less resistance to form change than other areas of said intermediate zone, said first form-changing area enabling said plug-in zone to move in a plug-in direction, as said intermediate zone is deformed, d) wherein said intermediate zone includes a second form-changing area with reduced resistance to form change, said second form-changing area having a deformation direction along an axis that is parallel to an axis of deformation direction of said first form-changing area.

2. The electric contact plug of claim 1, wherein said intermediate zone is configured at an angle between said first form-changing area and said second form-changing area.

3. The electric contact plug of claim 1, wherein said intermediate zone is configured as one or more angles.

4. The electric contact plug of claim 1, wherein said connection zone attaches said electric contact plug mechanically to said electronic component.

5. The electric contact plug of claim 1, wherein said plug-in zone receives said tip jack input device in the form of a contact tongue.

6. The electric contact plug of claim 1 wherein said first form-changing area and said second form-changing area have material cross-sections that are smaller than said other areas of said intermediate zone.

7. The electric contact plug of claim 6, wherein said first form-changing area has a thinner material thickness than said other areas of said intermediate zone.

8. The electric contact plug of claim 6, wherein said second form-changing area has a thinner material thickness than said other areas of said intermediate zone.

9. The electric contact plug of claim 1, wherein said plug-in zone comprises at least two receiving tongues to receive said tip jack input device, said receiving tongues having outer contours which are tapered in a direction away from said intermediate zone, when said tip jack input device is not plugged in.

10. The electric contact plug of claim 9, wherein at least part of the cross-sectional surface of each of said receiving tongues changes in a linear manner.

11. The electric contact plug of claim 1, wherein said electric contact plug is configured as a single unit.

12. An electric contact plug, for receiving a tip jack input device at a first end, and for connecting to an electronic component at a second end, comprising:

a) a plug-in zone at said first end, located within an L-shaped area of said electric contact plug, for receiving said tip jack input device, b) a connection zone at said second end, for connecting to said electronic component, c) an intermediate zone, located between said plug-in zone and said connection zone, wherein said intermediate zone comprises at least a first form-changing area, having less resistance to form change than other areas of said intermediate zone, said first form-changing area enabling said plug-in zone to move in a plug-in direction, as said intermediate zone is deformed, d) wherein said connection zone is configured as one or more angles.

13. An electric contact plug, for receiving a tip jack input device at a first end, and for connecting to an electronic component at a second end, comprising:

a) a plug-in zone at said first end, located within an L-shaped area of said electric contact plug, for receiving said tip jack input device, b) a connection zone at said second end, for connecting to said electronic component, c) an intermediate zone, located between said plug-in zone and said connection zone, wherein said intermediate zone comprises at least a first form-changing area, having less resistance to form change than other areas of said intermediate zone, said first form-changing area enabling said plug-in zone to move in a plug-in direction, as said intermediate zone is deformed, d) wherein said connection zone includes a bonding area, for connection to said electronic component by means of bonding.

14. The electric contact plug of claim 13, wherein said connection zone is coated with aluminum in said bonding area.

15. The electric contact plug of claim 13, wherein said connection zone is galvanically coated in said bonding area.

16. An electric contact plug, for receiving a tip jack input device at a first end, and for connecting to an electronic component at a second end, comprising:

a) a plug-in zone at said first end, located within an L-shaped area of said electric contact plug, for receiving said tip jack input device, b) a connection zone at said second end, for connecting to said electronic component, c) an intermediate zone, located between said plug-in zone and said connection zone, wherein said intermediate zone comprises at least a first form-changing area, having less resistance to form change than other areas of said intermediate zone, said first form-changing area enabling said plug-in zone to move in a plug-in direction, as said intermediate zone is deformed, d) wherein a receiving device is used to house said electric contact plug, said receiving device having an internal holding means for immobilizing said connection zone of said electric contact plug within said receiving device, e) wherein said receiving device further comprises a motion limitation means for limiting the movement of said plug-in zone within said receiving device.

17. The electric contact plug of claim 16, wherein said motion limitation means of said receiving device limits the deformability of said intermediate zone within said receiving device.

18. The electric contact plug of claim 17, wherein said receiving device comprises two parts, which have a separation plane that is essentially perpendicular to said axis of deformation direction of said first form-changing area.

19. The electric contact plug of claim 17, wherein said receiving device comprises two parts, which have a separation plane that is essentially parallel to said axis of deformation direction of said first form-changing area.

20. The electric contact plug of claim 16, wherein said receiving device can be fixed within an electrical device by means of extrusion-coating.

* * * * *